US010163598B2

(12) United States Patent
Lee

(10) Patent No.: US 10,163,598 B2
(45) Date of Patent: Dec. 25, 2018

(54) EXTINGUISHING UNIT OF MOLDED CASE CIRCUIT BREAKER

(71) Applicant: LSIS CO., LTD., Gyeonggi-do (KR)

(72) Inventor: Yeon-Woo Lee, Gyeonggi-do (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/713,013

(22) Filed: Sep. 22, 2017

(65) Prior Publication Data

US 2018/0122611 A1 May 3, 2018

(30) Foreign Application Priority Data

Nov. 2, 2016 (KR) ..... 10-2016-0145359

(51) Int. Cl.
*H01H 9/36* (2006.01)
*H01H 9/34* (2006.01)
(Continued)

(52) U.S. Cl.
CPC ..... *H01H 73/18* (2013.01); *H01H 9/36* (2013.01); *H01H 33/08* (2013.01); *H01H 9/346* (2013.01)

(58) Field of Classification Search
CPC .... H01H 33/08; H01H 2033/085; H01H 9/36; H01H 9/362; H01H 9/346;
(Continued)

(56) References Cited

U.S. PATENT DOCUMENTS 2,468,422 A 4/1949 Wood
3,440,378 A * 4/1969 Baird ..... H01H 9/36 218/151
(Continued)

FOREIGN PATENT DOCUMENTS

CN 201975359 U 9/2011
CN 202159641 U 3/2012
(Continued)

OTHER PUBLICATIONS

Translation of KR 2020110005809 (orig. doc. published Sep. 18, 2015).*
(Continued)

*Primary Examiner* — Edwin A. Leon
*Assistant Examiner* — William Bolton
(74) *Attorney, Agent, or Firm* — K&L Gates LLP

(57) ABSTRACT

The present disclosure relates to an extinguishing unit for a molded case circuit breaker, and more particularly, to an extinguishing unit for a molded case circuit breaker that has grids double-arranged in an extinguishing part to improve arc extinguishing performance.

According to an embodiment of the present disclosure, an extinguishing unit for a molded case circuit breaker includes a pair of side plates arranged to face each other and a plurality of grids arranged in a space defined between the pair of side plates, wherein the grids include a plurality of first grids arranged at a front portion of the pair of side plates; and a plurality of second grids arranged at a rear portion of the pair of side plates, wherein a re-division space for re-dividing an arc is defined between the first grids and the second grids.

10 Claims, 6 Drawing Sheets

(51) Int. Cl.
*H01H 33/08* (2006.01)
*H01H 73/18* (2006.01)

(58) Field of Classification Search
CPC ..... H01H 2009/365; H01H 2009/367; H01H 73/18; H01H 73/02; H01H 73/12; H01H 33/04; H01H 33/52
USPC .... 218/85, 15, 34, 38, 46, 76, 81, 105, 149, 218/156; 200/144 R, 146 R, 148 C
See application file for complete search history.

(56) References Cited

U.S. PATENT DOCUMENTS

| | | | | |
|---|---|---|---|---|
| 4,011,425 | A | 3/1977 | Gryctko | |
| 4,618,751 | A | 10/1986 | Wehr et al. | |
| 4,876,421 | A * | 10/1989 | Miller | H01H 9/34 218/150 |
| 5,866,864 | A * | 2/1999 | Mody | H01H 9/36 218/38 |
| 8,847,096 | B2 | 9/2014 | Juds et al. | |
| 2013/0015044 | A1* | 1/2013 | Lee | H01H 1/5822 200/175 |

FOREIGN PATENT DOCUMENTS

| | | | |
|---|---|---|---|
| CN | 202268271 | U | 6/2012 |
| CN | 103065896 | A | 4/2013 |
| EP | 1655752 | A1 | 5/2006 |
| JP | 56110552 | U1 | 1/1955 |
| JP | H1-122538 | A | 5/1989 |
| JP | H2-90422 | A | 3/1990 |
| JP | 2016-162585 | A | 9/2016 |
| KR | 20-0478314 | Y1 | 9/2015 |
| WO | 93/08585 | | 4/1993 |
| WO | 2015/113313 | A1 | 8/2015 |
| WO | 2015/188865 | A1 | 12/2015 |

OTHER PUBLICATIONS

European Search Report for related European Application No. 17165482.5; dated Oct. 27, 2017; (8 pages).
Chinese Office Action for related Chinese Application No. 201710262286.4; action dated Oct. 25, 2018; (9 pages).

* cited by examiner

EXTINGUISHING UNIT OF MOLDED CASE CIRCUIT BREAKER

CROSS-REFERENCE TO RELATED APPLICATIONS

This application claims the priority of Korean Patent Application No. 10-2016-0145359 filed on Nov. 2, 2016, in the Korean Intellectual Property Office, the disclosure of which is hereby incorporated by reference in its entirety.

BACKGROUND

1. Technical Field

The present disclosure relates to an extinguishing unit for a molded case circuit breaker, and more particularly, to an extinguishing unit for a molded case circuit breaker that has grids double-arranged in an extinguishing part to improve arc extinguishing performance.

2. Description of the Related Art

In general, a molded case circuit breaker (MCCB) is an electric device that protects circuits and loads by automatically shutting off the circuits in the event of electrical overload or short circuit.

FIG. 1 is a longitudinal sectional view showing a molded case circuit breaker according to the prior art. The MCCB according to the prior art includes a fixed contact arm 2*a* and a movable contact arm 2*b*, which constitute a contact portion provided in a case 1 formed of an insulation material to connect or disconnect a circuit between a power source side and a load side, an opening and closing mechanism 3 for providing a power for rotating the movable contact arm 2*b*, an extinguishing part 4 provided to extinguish an arc generated when a fault current is interrupted, and a detection mechanism 5 for detecting an abnormal current.

An arc is generated between the fixed contact arm 2*a* and the movable contact arm 2*b* when flow of a fault current is interrupted by separating the movable contact arm 2*b* from the fixed contact arm 2*a*. The intensity of the arc is proportional to the magnitude of the current. The arc is generated when a gas in the atmosphere instantly reaches a plasma state. The temperature at the arc center reaches 8,000 to 12,000° C. and the arc has an explosive expansion pressure. Such arc melts and consumes the contact arms, and deteriorates or destroys the insulation material. Accordingly, persistence of the arc significantly affects the performance of the MCCB. Therefore, the arc should be quickly interrupted and extinguished in the extinguishing part 4 and be discharged from the extinguishing part 4.

As described above, in an MCCB, triggering a trip operation in the event of a fault current and extinguishing and discharging the arc generated according to the current are core operations in protecting the product, the loads and the cable by cutting off the fault current, and are directly related to performance of the circuit breaker.

FIGS. 2 and 3 are partially detailed views of an arc extinguishing part. FIG. 2 is a side view of an arc extinguishing part shown along with a contact portion, and FIG. 3 is a perspective view of an arc extinguishing part.

The movable contact arm 2*b* is pivotably coupled to a shaft 6, which is rotated by the power transferred from the opening and closing mechanism 3. The contact portion where the fixed contact of the fixed contact arm 2*a* meets the movable contact of the movable contact arm 2*b* is disposed inside the side plates of the extinguishing part 4.

The extinguishing unit, mainly used for the arc extinguishing part of the MCCB, is a cold cathode type extinguishing chamber using a metal plate. The extinguishing unit is formed by perpendicularly arranging grids 4*b*, which are made of a steel plate having a V-shaped groove and spaced an appropriate distance from each other, with respect to an arc generation path. When the contact arms 2*a* and 2*b* are separated and an arc is generated, the arc moves to the grids 4*b* within the side plates 4*a*. The arc is cooled by the grids 4*b* and divided into short arcs in between the grids 4*b*, whereby the arc voltage is increased and the current is reduced. In addition, an extinguish gas generated in the insulation plate (not shown) constituting the extinguishing part increases the internal pressure of the case, compresses the arc at a high pressure and suppresses release of free electrons, thereby quickly extinguishing the arc and recovering the inter-pole voltage.

As described above, minimizing consumption of the contact between the contact arms due to an arc and suppressing molten missiles by quickly extinguishing the arc in the event of short circuit is an important factor in implementing the basic function of the MCCB.

The MCCB according to the prior art has a current blocking capability of interrupting a fault current in a short time by suppressing the short-circuit current by increasing an arc voltage generated during short circuit breakdown. However, if the arc generated between the contacts in the short circuit breakdown is not completely cooled down by the grids to be extinguished, the grids in the extinguishing chamber may be damaged or even collapsed, malfunction occur due to missiles produced by melting of the grids, and the consumed amount of the contact may increase. Furthermore, while the MCCB becomes compact, an increased breaker capacity is required. Therefore, there is a need for enhancement of the extinguishing performance of the MCCB.

SUMMARY

The present disclosure has been made in an effort to solve the above-mentioned problems, and it is an object of the present disclosure to provide an extinguishing unit for a molded case circuit breaker which has grids double-arranged in an extinguish part in order to improve arc extinguishing performance.

Objects of the present disclosure are not limited to the above-described objects and other objects and advantages can be appreciated by those skilled in the art from the following descriptions. Further, it will be easily appreciated that the objects and advantages of the present disclosure can be practiced by means recited in the appended claims and a combination thereof.

In accordance with one aspect of the present disclosure, an extinguishing unit for a molded case circuit breaker includes a pair of side plates arranged to face each other and a plurality of grids arranged in a space defined between the pair of side plates, wherein the grids include a plurality of first grids arranged at a front portion of the pair of side plates; and a plurality of second grids arranged at a rear portion of the pair of side plates, wherein a re-division space for re-dividing an arc is defined between the first grids and the second grids.

Herein, the first grids are inclined up in a rearward direction at a first inclination angle with respect to a bottom surface of a case, and the second grids are inclined up in the rearward direction at a second inclination angle with respect to the bottom surface of the case.

The second inclination angle may be greater than the first inclination angle.

A front portion of each of the first grids may be provided with a first cutout portion, the first cutout portion providing a space in which the movable contact arm is rotatable and a space in which the arc is dividable.

A front portion of each of the second grids may be provided with a second cutout portion, the second cutout portion providing a space in which the arc is re-dividable.

The number of the first grids may be equal to the number of the second grids.

The first grids may partially protrude from a front of the side plates, and the second grid may partially protrude from a back of the side plates.

Each of the side plates may be provided with first fitting holes allowing the first grids to be fitted thereinto and a second fitting hole allowing the second grids to be fitted thereinto.

An intermediate space may be defined between the first grids and the second grids.

The second grids may be shorter than the first grids.

An auxiliary grid having a cutout portion and a protrusion at a center thereof may be provided on top of the first grids.

According to an extinguishing unit of a molded case circuit breaker of the present disclosure, grids is horizontally double-arranged in an extinguishing part, and thus division and cooling of an arc occurs twice. Therefore, the arc extinguishing performance may be improved.

Further, an intermediate space is formed between first grids and second grids, and therefore the effect of division and cooling of an arc may be further enhanced.

DETAILED DESCRIPTION

Hereinafter, embodiments of the present invention will be described in detail with reference to the accompanying drawings. It should be understood that the present invention is not limited to the following embodiments and that the embodiments are provided for illustrative purposes only.

Figure 1:
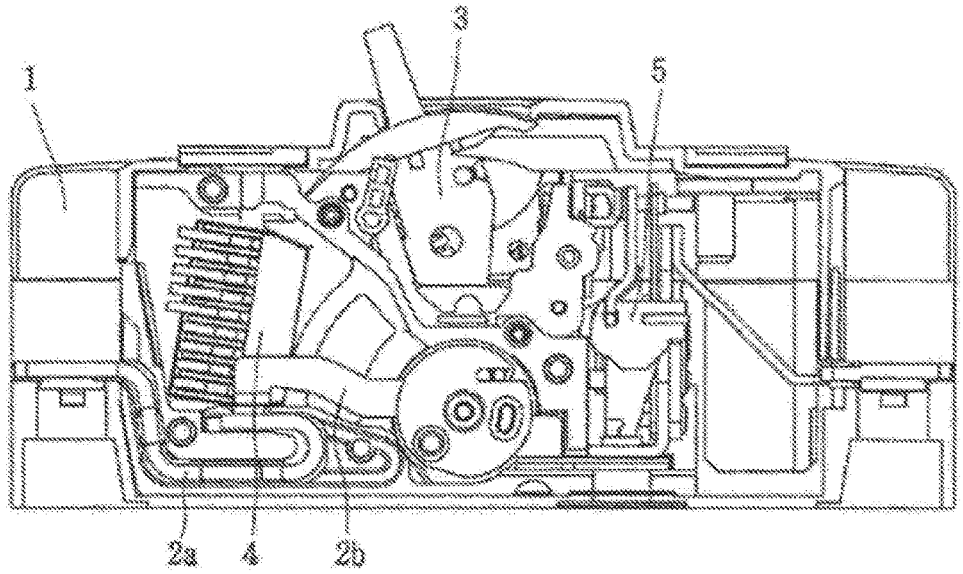
FIG. 1 (PRIOR ART)
FIG. 1 is a schematic view showing a molded case circuit breaker according to the prior art.
Figure 2:
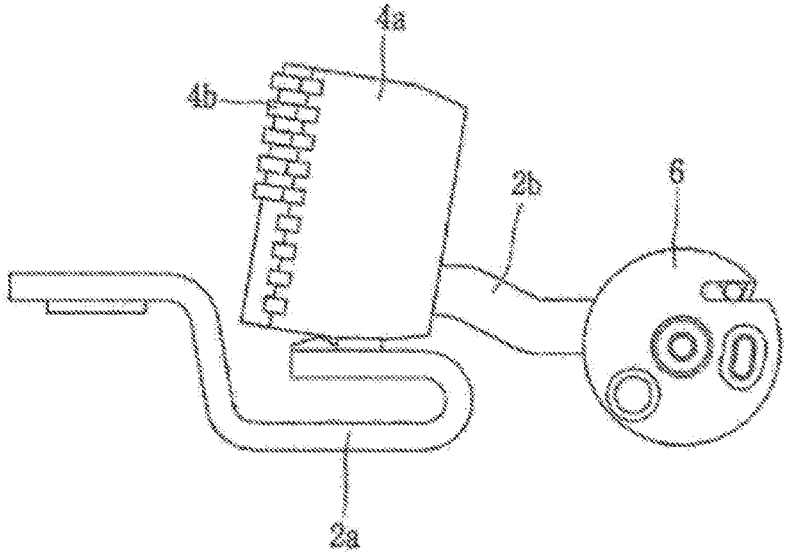
FIG. 2 (PRIOR ART)
FIG. 2 is a partially detailed view of an extinguishing part in FIG. 1.
Figure 3:
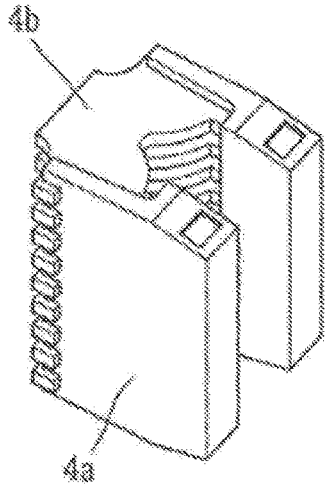
FIG. 3 (PRIOR ART)
FIG. 3 is a perspective view of an arc chamber in FIG. 1.
Figure 4:
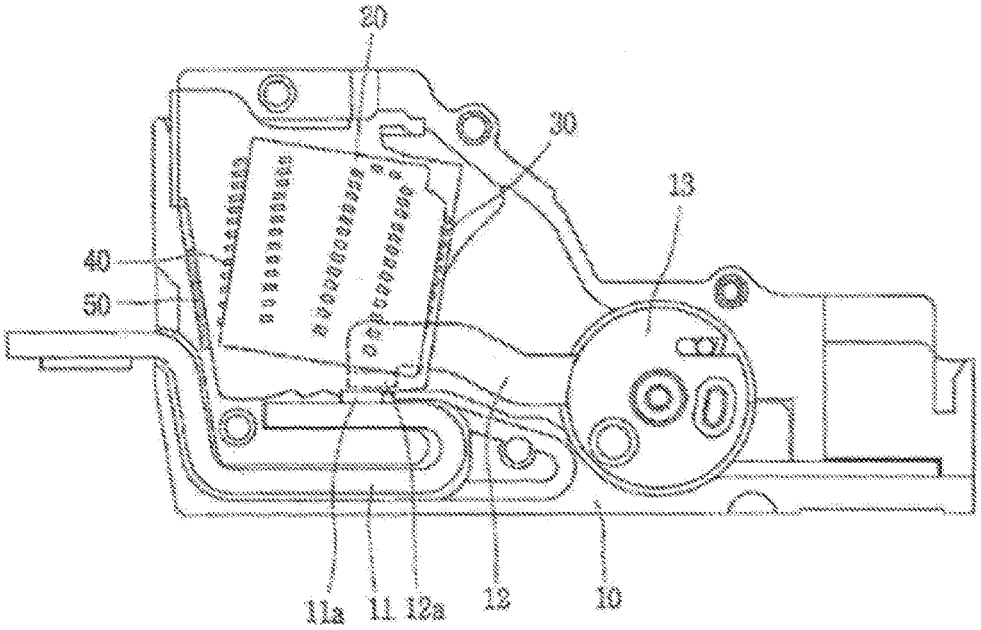
FIG. 4 is a side view illustrating a molded case circuit breaker to which an extinguishing unit for a molded case circuit breaker according to an embodiment of the present disclosure is applied.
Figure 5:
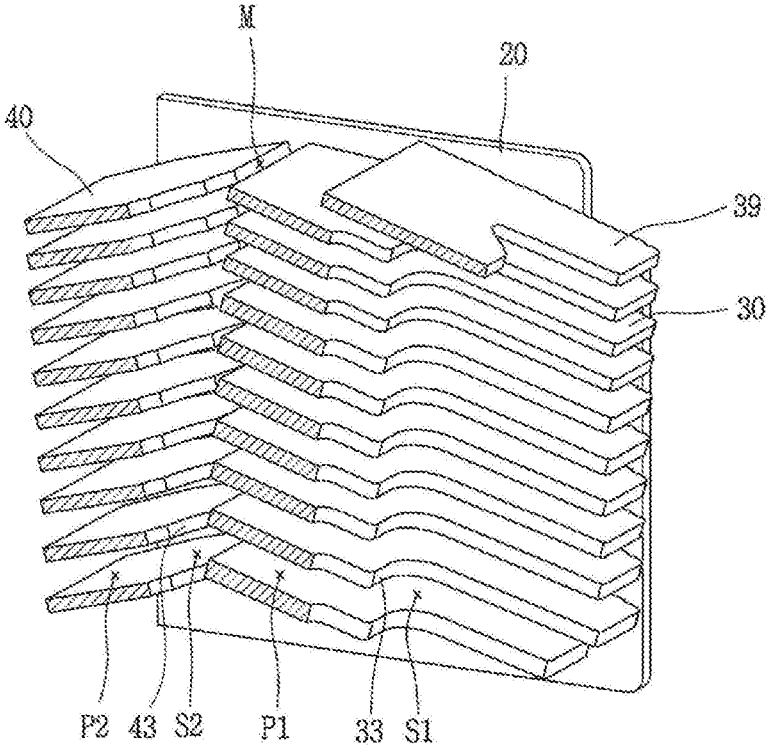
FIGS. 5 to 7 are a perspective view, a side view, and a plan view illustrating an extinguishing unit for a molded case circuit breaker according to an embodiment of the present disclosure.
Figure 6:
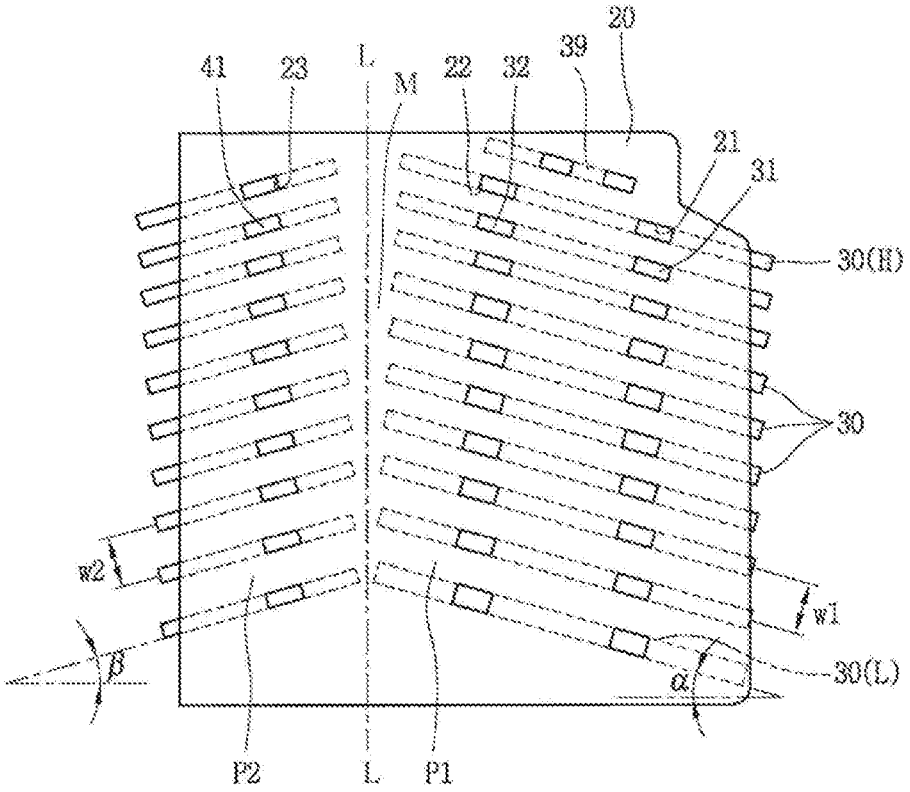
Figure 7:
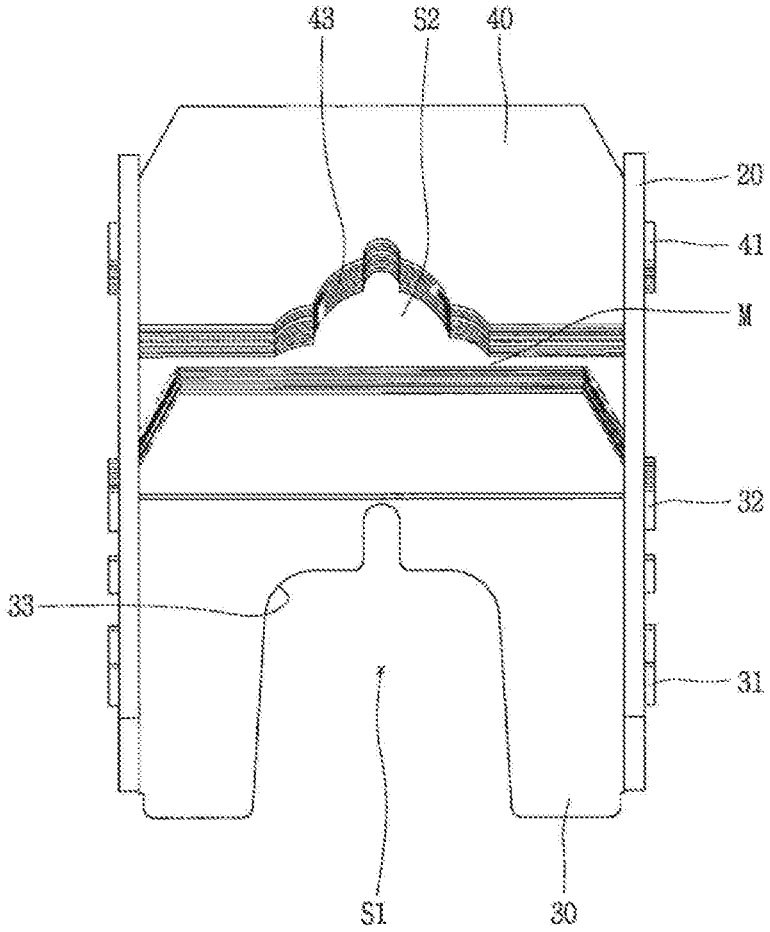

FIG. 4 is a side view illustrating a molded case circuit breaker to which an extinguishing unit for a molded case circuit breaker according to an embodiment of the present disclosure is applied. FIGS. 5 to 7 are a perspective view, a side view, and a plan view illustrating an extinguishing unit for a molded case circuit breaker according to an embodiment of the present disclosure. Hereinafter, an arc extinguishing unit for a molded case circuit breaker according to each embodiment of the present disclosure will be described in detail with reference to the drawings.

An extinguishing unit for a molded case circuit breaker according to an embodiment of the present disclosure includes a pair of side plates 20 and an arc extinguishing part, which includes a plurality of grids arranged between the pair of side plates 20 and spaced apart from each other by a predetermined distance. The grids include a plurality of first grids 30 arranged at a front portion of the pair of side plates 20 and a plurality of second grids 40 arranged at a rear portion of the pair of side plates 20. A re-division space S2 in which the arc may be re-divided is formed between the first grid 30 and the second grid 40.

The MCCB is provided with a base assembly 10 capable of accommodating a contact portion and a extinguishing part in a case (not shown). In the case of a multi-pole MCCB, base assemblies 10 as many as the phases may be provided.

A fixed contact arm 11 connected to the load side circuit or the power source side circuit and a movable contact arm 12 which can be brought into contact with or separated from the fixed contact arm 11 are provided in the base assembly 10. The movable contact arm 12 is coupled to a shaft assembly 13 which is rotated by the power from an opening and closing mechanism (not shown), and may be rotated by the shaft assembly 13. When the movable contact arm 12 rotates and contacts the fixed contact arm 11, electricity is applied to the circuit. When the movable contact arm 12 is disconnected from the fixed contact arm 11, the circuit is shut off. An arc extinguishing part is provided around the contact portion between the fixed contact 11*a* of the fixed contact arm 11 and the movable contact 12*a* of the movable contact arm 12.

The arc extinguishing part includes a pair of side plates 20 and grids 30 and 40. The pair of side plates 20 symmetrically faces each other to form a pair of side walls and the grids 30 and 40 are arranged between the pair of side plates 20 with a plurality of steel plates arranged in parallel and spaced a predetermined distance from each other. An inner space in which the arc can be surrounded by the side plates 20 and the grids 30 and 40 and extinguished is formed in the arc extinguishing part.

When the circuit is in a normal state, a current flows as the fixed contact 11*a* of the fixed contact arm 11 and the movable contact 12*a* of the movable contact arm 12 are connected to each other. When a fault current is generated in the circuit, the movable contact arm 12 is rotated by the mechanism (not shown), and thus the movable contact 12*a* is separated from the fixed contact 11*a* and the current is cut off. At this time, an arc of high temperature and high pressure is generated between the movable contact 12*a* and the fixed contact 11*a*.

In the circuit, the current is interrupted when the fixed contact arm is disconnected from the movable contact arm, and is allowed to flow when the fixed contact arm and the movable contact arm are brought into contact with each other. When the movable contact is disconnected from the fixed contact, an arc is generated due to the inertia of the current. That is, an arc is generated between the fixed contact arm 11 and the movable contact arm 12. This arc is a phenomenon that takes place when the atmosphere, which serves as an insulator, changes to a conductor of a plasma state as dielectric breakdown is caused by a voltage. The arc increases in proportion to the magnitude of the current. The temperature at the center of the arc ranges from 8,000° C. to 12,000° C. and the arc has an explosive expansion pressure. Accordingly, the arc melts and consumes the contact arms, and deteriorates or destroys the insulation material.

The arc is divided into short arcs as it enters the space between the grids 30 and 40. Thereby, the arc voltage increases. The arc voltage is further increased by an arc extinguishing gas such as SF6 present in the extinguishing part. As a result, the arc is extinguished with release of free electrons suppressed.

The side plates 20 may be symmetrically provided in pair. The side plates 20 are preferably made of an insulation material. As a result, the arc generated at the time of interruption may be reflected by the side plates 20 and be collected by the grids 30 and 40.

Each of the side plates 20 may have a plurality of first fitting holes 21 and 22 and a plurality of second fitting holes 23. The first fitting holes 21 and 22 are formed at the front of the side plate 20 (the right side in the figure, that is, a portion facing the central portion of the MCCB will be referred to as the front, and the left side in the figure, that is, a portion provided with a discharge port will be referred to as the back). The first grid 30 may be coupled to the first fitting holes 21 and 22. The second fitting holes 23 may be formed on the back of the side plate 20 and the second grid 40 may be coupled to the second fitting holes 23.

The grids 30 and 40 are provided to absorb and extinguish the arc. The grids 30 and 40 include a plurality of first grids 30 provided at the front portion of the pair of side plates 20 and a plurality of second grids 30 provided at the rear portion of the pair of side plates 20.

The first grids 30 may be formed as a flat plate. The first grids 30 may be formed of steel to facilitate suction of the arc. First fitting projections 31 and 32 for coupling the first grid 30 to the side plates 20 may be formed both sides of the first grid 30 in a protruding manner. The first grid 30 is installed on the side plates 20 by fitting the first fitting projections 31 and 32 into the first fitting holes 21 and 22. To ensure stable coupling between the first grid 30 and the side plates 20, a caulking operation may be performed on the first fitting projections 31 and 32.

The first grid 30 is provided with a first cutout portion 33. The first cutout portion 33 is formed by cutting the center portion of the front portion (the right part in the figure) of the first grid 30. The first cutout portion 33 is provided to define a space in which the movable contact arm 12 can operate, and a space which the arc can be divided.

The first cutout portion 33 may be formed as a V-shaped groove, a U-shaped groove or the like. The central portion of the first cutout portion 33 may be provided with a groove formed by cutting out a part thereof. As the groove is additionally formed in the first cutout portion 33, the arc dividing performance of the extinguishing unit may be further improved.

The arc extinguishing unit is provided with a plurality of first grids 30. The plurality of first grids 30 may be arranged on the side plates 20 in multiple layers such that the first grids 30 are spaced a predetermined distance from each other. Accordingly, a first passage P1 through which an arc can pass is provided between the plurality of first grids 30 arranged in multiple layers. A first spacing w1, which is a spacing provided in stacking the first grids 30, may be appropriately set in consideration of division of the arc and the suction force. Herein, the width of the first passage P1 corresponds to the first spacing w1 excluding the thickness of the first grid 30.

The first grid 30 may be obliquely arranged on the side plates 20. The first grid 30 may be arranged to form a first inclination angle $\alpha$ with respect to the bottom surface of the case or the base assembly 10 or the horizontal plane so as to be inclined up in the backward direction. Thereby, it is easy to absorb the arc which is dispersed and scattered in a radial direction. The first grid 30 obliquely arranged as described above may be disposed to surround the arc while forming a plane nearly perpendicular to the direction of rotation of the movable contact arm 12.

As a plurality of first grids 30 are stacked on the side plates 20, a first division space S1 is formed at the interior of the first grid 30 surrounded by the first cutout portion 33. The arc generated upon interruption of the fault current is primarily divided in the first division space S1 and enters the space between the stacked first grids 30, namely, the first passage P1. As the arc is compressed by an extinguishing gas, the arc voltage rises, and the current decreases. While the arc passes through the first passage P1, heat is dissipated by the first grids 30.

The plurality of first grids 30 may be arranged such that a first grid 30 arranged at a higher position in the stack protrudes further forward. That is, the first grid 30 arranged at the highest position may be positioned to protrude forward by a predetermined distance over the first grid 30 arranged at the lowest position.

An auxiliary grid 39 may be provided on the top of the first grids 30. The auxiliary grid 39 has a shape similar to that of the first grid 30, but differs from the first grid 30 in that the auxiliary grid 39 has a protrusion formed at the center of the cutout portion thereof. The auxiliary grid 39 serves to prevent the arc from escaping to the outside, as the last grid provided in the arc extinguishing part. Particularly, since the protrusion formed at the center of the cutout portion in a protruding manner is provided as a protruding structure for blocking the arc, leakage of the arc may be very effectively prevented by the auxiliary grid 39. The auxiliary grid 39 is shown in the perspective view of FIG. 5, the side view of FIG. 6. For simplicity, the auxiliary grid 39 is not shown in the plan view of FIG. 7.

The second grids 40 are arranged at a rear portion of the pair of side plates 20. The second grid 40 may have a form similar to that of the first grid 30. The second grid 40 may be formed as a flat plate. The second grid 40 may be formed of a steel material to facilitate suction of the arc.

Second fitting projections 41 for coupling the second grid 40 to the side plates 20 may be formed on both sides of the second grid 40 in a protruding manner. The second grid 40 is arranged on the side plates 20 by fitting the second fitting projection 41 into the second fitting holes 23. To ensure stable coupling between the second grid 40 and the side plates 20, a caulking operation may be performed on the second fitting projection 41.

The second grid 40 may be formed to be shorter than the first grid 30. Considering that the arc has already been divided and cooled once within the first grid 30, the second grid 40 may be formed to be shorter than the first grid 30 because additional division and cooling of the arc are performed within the second grid 40. Accordingly, while the two first fitting projections 31 and 32 are formed on the first grid 30, only one second fitting projection 41 is formed on the second grid 40.

The second grid 40 is provided with a second cutout portion 43. The second cutout portion 43 is formed by cutting the central portion of the front portion (the right part in the figure) of the second grid 40. The second cutout portion 43 is provided to define a space in which the arc can be re-divided. The second cutout portion 43 may be formed as a V-shaped groove, a U-shaped groove, or the like. The second cutout portion 43 may be provided with a groove formed at the central portion thereof by partially cutting away the central portion. As the groove is additionally formed in the second cutout portion 43, the arc dividing performance of the extinguishing unit may be further improved. Here, the area of the second cutout portion 43 may be smaller than that of the first cutout portion 33. Considering that the space in which the movable contact arm 12 operates and the space for initial diffusion of the arc are provided by the first cutout portion 33, the first cutout portion 33 is preferably formed to be larger than the second cutout portion 43.

The extinguishing unit is provided with a plurality of second grids 40, which may be arranged on the side plates 20 in multiple layers and spaced a predetermined distance from each other. Accordingly, a second passage P2 through which the arc can pass is provided between the plurality of second grids 40 arranged in multiple layers.

The second spacing w2, which is the spacing provided in stacking the second grids 40, may be appropriately set in consideration of the division of the arc and the suction force. Here, the width of the second passage P2 corresponds to the second spacing w2 excluding the thickness of the second grid 40. The second spacing w2 may be equal to the first spacing w1. In addition, the second grids 40 may be arranged such that an extension of the second passage P2 is connected to an extended path of the first passage P1. Accordingly, the arc may smoothly flow into the second passage P2 via the first passage P1. When the first spacing w1 and the second spacing w2 are equal to each other as described above, the number of the first grids 30 may be equal to that of the second grid 40.

The second grid 40 may be obliquely arranged on the side plate 20. The second grid 40 may be arranged to form a second inclination angle β with respect to the bottom surface of the case or the base assembly 10 or the horizontal plane so as to be inclined down in the backward direction. Thereby, the arc gas easily moves to the discharge port 50, passing through the second passage P2. Here, the second inclination angle β may be greater than or equal to the first inclination angle α. The second inclination angle β may be set in consideration of the distance to the discharge port 50 and the length of the second grid 40, and the like. Of course, the second inclination angle β is determined within an acute angle range.

When the first spacing w1 and the second spacing w2 are equal to each other and the first inclination angle α is equal to the second inclination angle β, the first grids 30 and the second grids 40 may form a symmetrical arrangement. FIG. 6 shows the symmetrical arrangement with respect to line segment L-L.

In order to effectively concentrate the exhaust gas at the discharge port 50, the second inclination angle β may be set to be greater than the first inclination angle α.

As a plurality of second grids 40 is stacked on the side plate 20*s*, a second division space S2 is formed at the interior of the second grids 40 surrounded by the second cutout portion 43. The arc exiting through the first grids 30 is re-divided in the second division space S2 and enters the gaps in the stack of the second grids 40, namely, the second passage P2. As the arc is divided and cooled once again in the second division space S2 and the second passage P2, the arc is finally extinguished, and no residual arc current is left.

The plurality of second grids 40 may be arranged such that the second grid 40 at a higher position protrudes further rearward. That is, the second grid 40(H) arranged at the highest position may be positioned to protrude rearward by a predetermined distance over the second grid 40(L) arranged at the lowest position. The stack of grids from the second grid 40(L) arranged at the lowest position may be positioned so as to gradually protrude backward.

An intermediate space M may be defined between the first grids 30 and the second grids 40. The intermediate space M is defined by arranging the first grids 30 spaced apart from the second grids 40 within the side plates 20. The arc is divided in the first division space S1, passed through the first passage P1 and then discharged to the intermediate space M. Then, the arc is re-divided in the second division space S2. Finally, the arc is cooled through the second passage P2 and discharged through the discharge port 50.

The arc is elevated at a predetermined angle while passing through the first grids 30 and is lowered at a predetermined angle while passing through the second grids 40. However, the arc is moved along a path that is generally horizontal. That is, since all the grids including the first grids 30 and the second grids 40 are arranged horizontally, the effect of extinguishing and cooling of the arc may be enhanced. In addition, since the arc is re-mixed in the intermediate space M and then re-divided in the second division space S2, the arc division and cooling effect of the extinguishing unit may be maximized.

Figure 8:
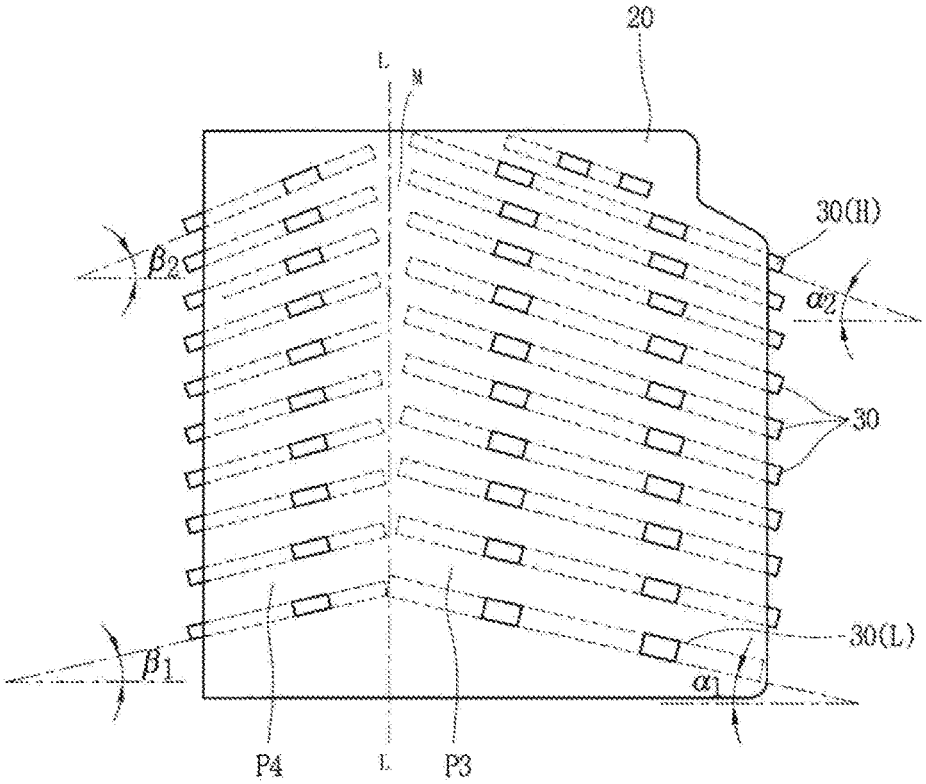
FIG. 8 is a side view illustrating an extinguishing unit for a molded case circuit breaker according to another embodiment of the present disclosure.

FIG. 8 is a longitudinal sectional view illustrating an arc extinguishing unit of an MCCB according to another embodiment of the present disclosure. The components in this embodiment are the same as those in the previous embodiment.

In this embodiment, the first grid 30 arranged at the highest position may be inclined at an angle greater than the inclination angle of the first grid 30(H) arranged at the lowest position. Preferably, the inclination angle may be set to gradually increase from the first grid 30(L) at the lowest position to the first grid at the highest position. Accordingly, the outlet of the third passage P3 is wider than the inlet of the third passage P3. The arc passing through the third passage P3 formed in this way is sucked at the inlet of the third passage P3 at a high speed and the flow rate is lowered inside the third passage P3. As a result, the duration for which the arc stays in the third passage P3 is increased, and therefore the arc cooling effect may be enhanced.

The second grids 40 is disposed on the back of the side plates 20 and are spaced apart from the first grids 30. The second grid 40(H) at the highest position may be arranged at an inclination angle greater than the inclination angle of the second grid 40(L) at the lowest position. Thereby, the inclination angle of the stack of the grids may gradually increase from the first grid 30 at the lowest position to the first grid 30 at the highest position. Accordingly, the outlet of the fourth passage P4 is narrower than the inlet of the fourth passage P4. The arc is divided into arcs with sufficient spacing therebetween to facilitate re-division of the arc, and sucked into the second grids 40. The flow rate of the arc increases in the fourth passage P4, and thus the arc moves fast to the discharge port 50.

In the extinguishing unit for the MCCB according to an embodiment of the present disclosure, the grids are double-arranged in the horizontal direction in the extinguishing part, and therefore the arc is divided and cooled twice. Thereby, arc extinguishing performance may be improved.

Further, as an intermediate space is formed between the first grids and the second grids, the effect of division and cooling of the arc is further enhanced.

While the present disclosure has been particularly shown and described with reference to exemplary embodiments thereof, it is to be understood that the disclosure may be embodied otherwise without departing from the spirit and scope of the disclosure. Therefore, the embodiments disclosed in the present disclosure are not intended to limit the scope of the present disclosure, and the scope of the technical idea of the present disclosure is not limited by the embodiments. That is, the scope of protection sought by the present disclosure should be construed in accordance with the appended claims, and all technical ideas within the scope of equivalents thereof should be construed as being included in the scope of the present disclosure as defined in the claims.

What is claimed is:

1. An extinguishing unit for a molded case circuit breaker comprising:

a pair of side plates arranged to face each other; and a plurality of grids arranged in a space defined between the pair of side plates, wherein the grids comprise:

a plurality of first grids arranged at a front portion of the pair of side plates; and a plurality of second grids arranged at a rear portion of the pair of side plates, wherein a re-division space for re-dividing an arc is defined between the first grids and the second grids, wherein the first grids are inclined up in a rearward direction with respect to a bottom surface of a case or a base assembly, and the second grids are inclined down in the rearward direction with respect to the bottom surface of the case or the base assembly.

2. The extinguishing unit according to claim 1, wherein the first grids are inclined to form a first inclination angle with the bottom surface of the case, and the second grids are inclined to form a second inclination angle with the bottom surface of the case, wherein the second inclination angle is greater than the first inclination angle.

3. The extinguishing unit according to claim 1, wherein a front portion of each of the first grids is provided with a first cutout portion, the first cutout portion providing a space in which the movable contact arm is rotatable and a space in which the arc is dividable.

4. The extinguishing unit according to claim 1, wherein a front portion of each of the second grids is provided with a second cutout portion, the second cutout portion providing a space in which the arc is re-dividable.

5. The extinguishing unit according to claim 1, wherein a number of the first grids is equal to a number of the second grids.

6. The extinguishing unit according to claim 1, wherein the first grids partially protrude from a front of the side plates, and the second grids partially protrude from a back of the side plates.

7. The extinguishing unit according to claim 1, wherein each of the side plates is provided with first fitting holes allowing the first grids to be fitted thereinto and a second fitting hole allowing the second grids to be fitted thereinto.

8. The extinguishing unit according to claim 1, wherein an intermediate space is defined between the first grids and the second grids.

9. The extinguishing unit according to claim 1, wherein the second grids are shorter than the first grids.

10. The extinguishing unit according to claim 1, wherein an auxiliary grid having a cutout portion and a protrusion at a center thereof is provided on top of the first grids.

* * * * *